United States Patent [19]

Nolan

[11] Patent Number: 4,651,361

[45] Date of Patent: Mar. 24, 1987

[54] PORTABLE COMBINATION HAIR SHAMPOO BASIN AND DRYING HOOD

[76] Inventor: William D. Nolan, 3100 Grant St., Wichita Falls, Tex. 75308

[21] Appl. No.: 785,002

[22] Filed: Oct. 7, 1985

[51] Int. Cl.[4] ..... A45D 19/04

[52] U.S. Cl. ..... 4/516; 4/519; 4/520

[58] Field of Search ..... 4/515–523, 4/637, 543

[56] References Cited

U.S. PATENT DOCUMENTS

| | | | |
|---|---|---|---|
| 2,854,969 | 10/1958 | Nolan | 4/518 X |
| 3,068,491 | 12/1962 | Perekrestenko | 4/516 |
| 3,694,826 | 10/1972 | Push | 4/516 |

FOREIGN PATENT DOCUMENTS

| | | | |
|---|---|---|---|
| 2441686 | 3/1976 | Fed. Rep. of Germany | 4/543 |
| 2501022 | 9/1982 | France | 4/519 |
| 779950 | 7/1957 | United Kingdom | 4/517 |

*Primary Examiner*—Charles E. Phillips

*Attorney, Agent, or Firm*—Warren H. Kintzinger

[57] ABSTRACT

A portable combined hair shampoo basin and drying hood configured for use by a person reclining in a bed or on a couch such as a bedridden person although it may be used in the home by all family members for shampooing, hair coloring, permanent waving, and the drying of the hair thereafter. It is a box-like device that sits on the bed or couch having a double wall defined basin reservoir and a half moon cutout in a front wall to receive the neck of the user. The basin inner wall has a plurality of openings through which water passes when water is poured over the head from a pitcher to drain down through the openings into the reservoir. This keeps spent rinse water out of the upper basin section and away from clean hair with water draining from the reservoir container through a hose connected thereto during the shampoo process. After the shampoo process and water is drained from the reservoir a blow dryer inserted in an outer wall opening of the basin may be activated for use of the basin as a hair drying hood with hot air forced into the reservoir blowing out through the plurality of openings to impinge on a user's hair in the upper container of the basin.

14 Claims, 4 Drawing Figures

PORTABLE COMBINATION HAIR SHAMPOO BASIN AND DRYING HOOD

Figure 1:
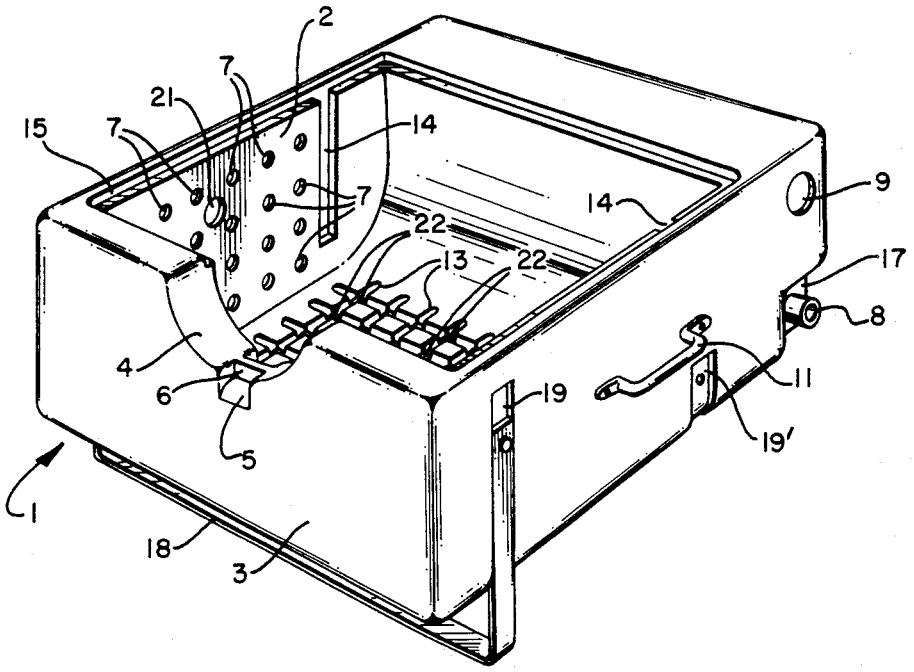

This invention relates in general to shampoo and scalp treatment basins, and more particularly, to a portable combined hair shampoo basin and drying hood configured in generally box form with a users neck supporting cutout for a reclining user.

Many hair shampoo and scalp treatment basins are heavy permanently fixed in place installations with heavy metal sink basins with special chairs required to support a person having a hair shampoo and scalp treatment. Such heavy fixed in place installations are generally found in beauty parlors and barber shops and not in the home, retirement home or invalids hospital room. These large and complex fixed in place installations are expensive to make and install, freely use water and require a special shampoo chair for the user. Various portable appliances have been made for shampooing hair of those confined to a bed. Many of the portable devices make use of water stored inside and as a result are heavy and awkward to use. Further, such devices require some kind of pump or pressure tank to force the water out and over head with extra equipment to go wrong and water to get cold and then with no convenient provisions for drying the hair after the shampoo. Substantially all these problems may be overcome through use of a pitcher to pour the water through the hair and on the scalp and thereafter drying the hair in the same basin used in a drying hood mode.

It is therefore a principal object of this invention to provide an efficient, portable combination hair shampoo basin and drying hood that is inexpensive in the market place.

Another object is to provide such a shampoo basin and drying hood placeable on a bed in the home or hospital bed for use by persons confined to bed.

A further object is to provide such a shampoo basin and drying hood in generally box shape having a neck receiving cutout in a front wall further with an additional cutout taking pressure off the cervical vertabrae of the user.

Still another object is to provide such a combined hair shampoo basin and drying hood useable for a user in a semi-reclining position.

A further object is to provide such a hair shampoo basin where even though spent rinse water is not completely drained from the basin hair is kept out of the spent water with the double wall construction.

Another object is to have distributed air flow for hair drying when a person is using the device in the drying hood mode.

Features of the invention useful in accomplishing the above objects include, in a new portable combination hair shampoo basin and drying hood, a unit package in rectangular box-like form with a handle for easy carrying like luggage. The unit is formed with an outer basin box having two sides, a front, a back and bottom and an inner basin container spaced from the outer basin box but joined thereto around the top by an upper rim wall. A half moon cutout from the top of the front wall is provided for receiving and supporting the neck of a user and a further cutout at the bottom thereof provides relief space and takes pressure off the cervical vertebrae of the user's neck. A water barrier ridge (or dam) is provided in this additional cutout to help divert water from leaking to the basin exterior. The basin inner wall has a plurality of openings through which water passes when water is poured over the head from a pitcher to drain down through the openings into the reservoir. This keeps spent water out of the upper basin section and away from clean hair with water draining from the reservoir container through a hose connected thereto during the shampoo process. After the shampoo process and water is drained from the reservoir a blow dryer inserted in an outer wall opening of the basin may be activated for use of the basin as a hair drying hood with hot air forced into the reservoir blowing out through the plurality of openings to impinge on a user's hair in the upper container of the basin. The inner basin bottom is additionally formed with a plurality of canals and with a plurality of openings at the bottoms of the canals and the inner basin side walls are also provided with a plurality of openings. A removable "U" shaped tubular conduit bracket is also provided equipped with a plurality of inwardly basin directed openings that when mounted in opposite side wall mount openings is positionable in an arc over the front and top of the head to direct blow drying air downward on the user's head as desired. This unit includes a removable tilt support bracket with grooves therefor on each of the outer sides to receive it with one set of grooves for storage of the support bracket and shampooing and a second set of grooves for hair drying. At least one indentation is provided located in any of the four bottom corners of the outer walls of the basin to provide a protective recess for a drain spout that could be located at the back or at the front. Opposite side aligned grooves in the internal side walls of the basin are provided to receive an optional baffle to shorten the drying compartment. An opening in the outer wall is provided for a hot air blowing device such as a hand held type blow dryer.

Figure 2:
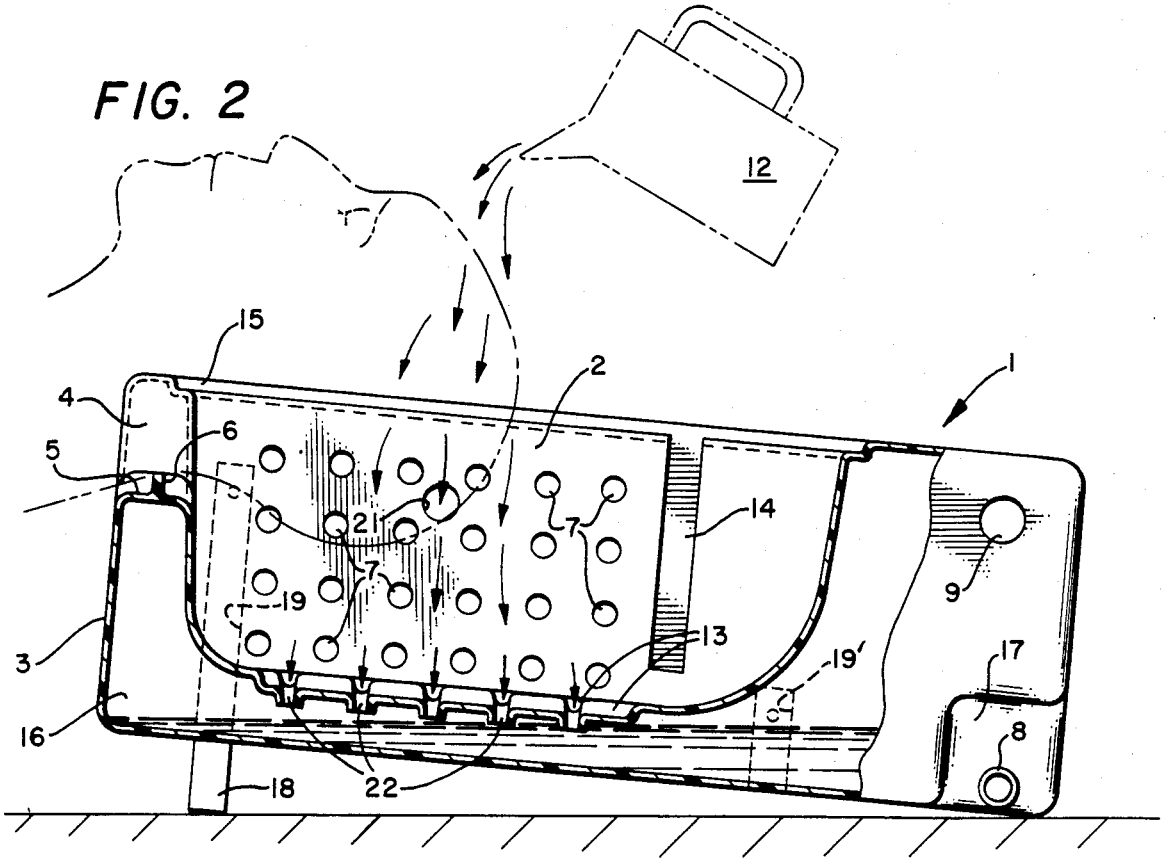
Figure 3:
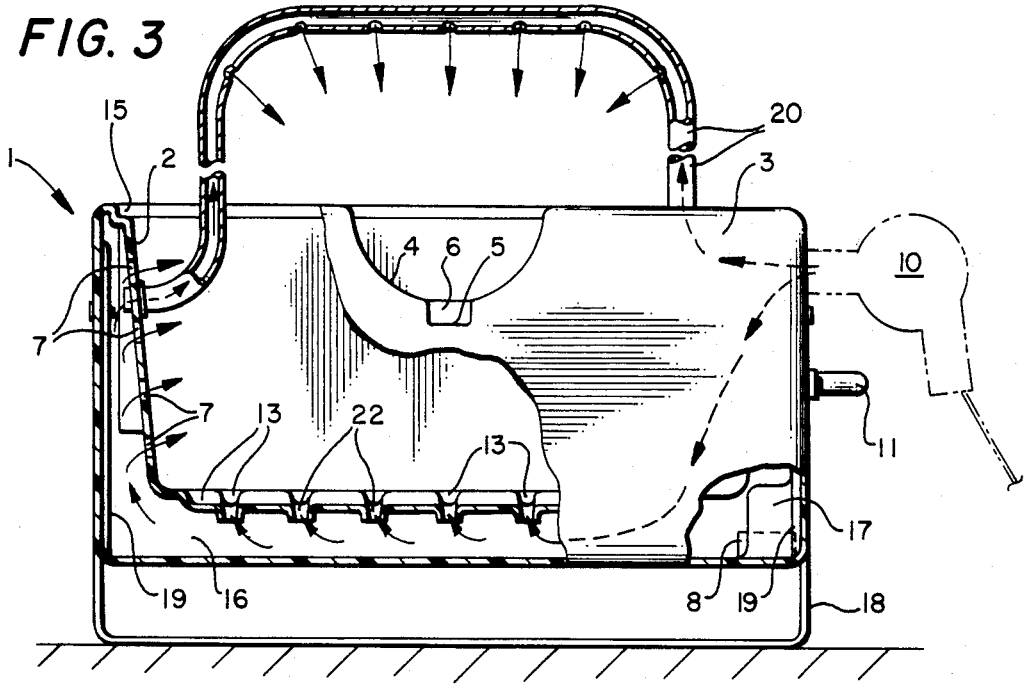
Figure 4:
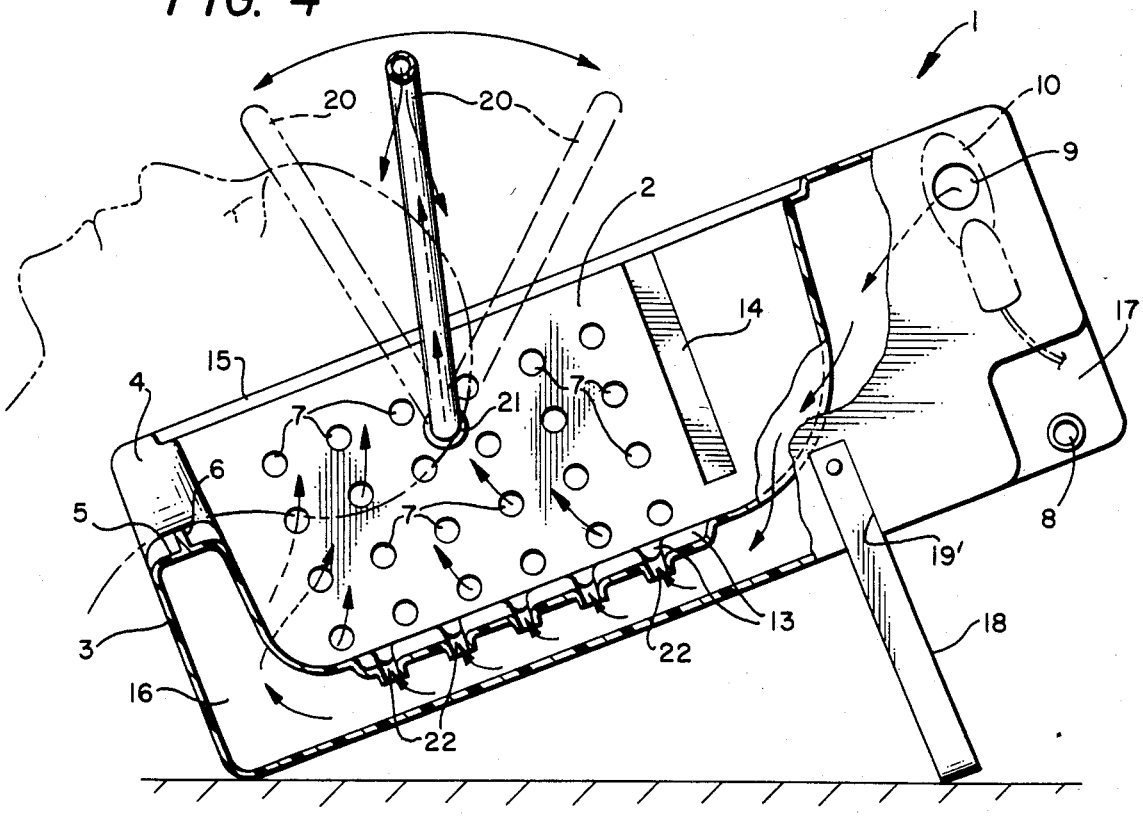

A specific embodiment representing what is presently regarded as the best mode of carrying out the invention is illustrated in the accompanying drawings:

In the drawings:

FIG. 1 is a perspective view of the combined hair shampoo and drying hood;

FIG. 2, a partially broken away and sectioned side elevation view of the combined hair shampoo basin and drying hood;

FIG. 3, a partially broken away and sectioned front elevation view of the hair shampoo basin and drying hood; and FIG. 4, a partially broken away and sectioned side elevation view of the combined hair shampoo basin and drying hood supported in the hair blow dry mode.

Referring to the drawings:

As shown in FIGS. 1–4 an outer basin box 1 comprised of two outer sides, a front, back and bottom encloses an inner basin 2 with the inner and outer basins spaced from each other and defining an enclosed space. The front 3 has a half moon cutout 4 that extends from the outer basin box 1 to the inner basin 2 and has a cervical vertebrae cutout 5 running through the bottom of the half moon cutout to relieve pressure from the cervical neck vertebrae of the user. A barrier (or dam) 6 is positioned in the cutout 5 to help prevent water leakage from the inner basin 2 through the cutout 5 to the exterior. The inner basin 2 is provided with openings 7 in its side wall. A water drain 8 extends from the interior of inner basin 2 to the exterior of basin box 1 with the outer end thereof in a bottom corner relief indentation 17 for protection thereof with it noted that this drain construction could be located at any one of the bottom four corners of the basin box 1. An opening 9 is provided in a wall of outer basin box 1 for a hot air blowing device such as a hair blow dryer 10 mounted with the outlet thereof inserted into the opening 9 for the blowing of hot air into the enclosed space between the outer basin box 1 and the inner basin 2. A handle 11 is provided on the outer basin box 1 for ease of carrying and a pitcher 12 is used for supplying water.

Channels 13 are formed in the bottom of the inner basin 2 and are provided with openings 22 to permit water to drain down through the openings during shampooing and rinsing and then thereafter during the hair dry mode air to enter through the openings 22 and 7 with the head and hair in place in the device. A pair of aligned grooves 14 are formed in opposite side walls of the inner basin 2 for receiving an optional baffle shortening the hair drying compartment. A recessed shoulder 15 is formed in the top of inner basin 2 for receiving an optional top cover (not shown) in the transporting state. The enclosed space between the outer basin box 1 and the inner basin 2 provides a reservoir 16 space at the bottom of the device storing spent rinse water while it slowly drains and during the blow dry mode guide hot blow air to and up out of openings 22 in the bottom and through openings 7 in opposite sides of the inner basin 2. A tilt support bracket 18 is used to tilt the device for spent rinse water drainage and to position the device for drying hair with the bracket 18 positionable, respectively, in grooves 19 and 19'. With bracket 18 in grooves 19 the device is tilted to drain water to drain 8 and when in grooves 19' the device is tilted for blow drying hair. A removable "U" shaped tubular conduit bracket 20 is mountable in opposite side openings 21 for pivotal movement in an arc over the front and top of the head to direct blow drying air downward from a pluraity of inwardly basin directed openings on the user's head as desired.

Operation of the portable combined hair shampoo basin and drying hood involves placement of the device on a bed or couch and connecting a plastic hose to the drain spout 8 with the hose extended to a suitable receptacle such as a plastic wastepaper basket. For optimized drainage tilt support is extended from grooves 19 to make the reservoir 16 drain to the back and out through drain spout 8 and the hose into the plastic basket or bucket. The user receiving a shampoo lies down with his or her neck resting in the half moon cutout 4. Water is poured over the user's head from pitcher 12 and shampoo is added to the hair and the scalp and hair then massaged. Thereafter water from the pitcher is again poured over the hair of the head for rinsing it clean with the process repeated at least one additional time. After the reservoir 16 is completely drained of spent rinse water the drain hose is removed and drain spout 8 capped to keep hot blow air from escaping. The tilt support 18 is moved to the back groove 19' in the hair drying position. Then with blow dryer 10 in place in opening 9 of outer basin box 1 and blowing, the user's hair will be dried in a few minutes ready for styling with a curling iron.

Whereas this invention has been described with respect to a single embodiment thereof, it should be realized that various changes may be made without departure from the essential contributions to the art made by the teachings hereof.

I claim:

1. A portable combination hair shampoo basin and drying hood comprising: a box-like structure having two opposite side outer walls, a bottom, a front end and a back end; an inner basin formed with two opposite side walls, a bottom, a front end and a back end all spaced from the corresponding portions of said box-like structure to form together an enclosure; said box-like structure and said inner basin joined at the top by interconnect wall means extending between like portions to complete said enclosure to thereby provide a double walled device varying in double wall thickness; a half moon cutout formed in the top of the front end double wall to receive the neck of the user; a plurality of openings in the bottom of said inner basin, and a plurality of openings in said two opposite side walls of said inner basin for the draining out of drain water and the reverse in flow of blow air in the drying hood mode; water drain means connected to the interior of the double walled enclosure; opening means in an outer wall of said box-like structure for receiving the outlet of a hot air blow device for use of the structure in the drying hood mode; wherein a second cutout is provided at the bottom of the neck receiving cutout extended in the same direction as that of the user's neck providing pressure and space relief to the cervix of the neck; and barrier means in said second cutout to prevent water leakage from said inner basin.

2. The portable combination hair shampoo basin and drying hood of claim 1, wherein a recessed shoulder is formed around the top of the inner basin to receive a top basin cover.

3. The portable combination hair shampoo basin and drying hood of claim 1, wherein a plurality of canals at different angles are provided in the inner basin bottom; and with the canals having a plurality of openings throughout their lengths.

4. The portable combination hair shampoo basin and drying hood of claim 1, wherein a removable "U" shaped conduit is mounted with opposite ends in opposite side openings of said inner basin and in fluid communication with the hot air in the double walled enclosure and pivotal with the ability to move in an arc over the user's head without interrupting the flow of hot air to that conduit when used in the drying hood mode.

5. The portable combination hair shampoo basin and drying hood of claim 1, wherein grooves are provided in the outer side walls; and tilt support bracket means receivable in said grooves to hold the device at desired angles in operation.

6. The portable combination hair shampoo basin and drying hood of claim 1, wherein opposite side grooves are provided in the two inner side walls of the inner basin to receive a baffle to shorten the drying compartment in the drying hood mode.

7. The portable combination hair shampoo basin and drying hood of claim 1, wherein a drain spout is mounted in a bottom corner of said box-like structure.

8. The portable combination hair shampoo basin and drying hood of claim 7, wherein said drain spout extends from within said enclosure to the exterior; and a indented relief area is provided in said box-like structure for the outlet end of said drain spout.

9. A portable hair drying hood comprising: a box-like structure having two opposite side outer walls, a bottom, a front end and a back end; an inner basin formed with two opposite side walls, a bottom, a front end and a back end all spaced from the corresponding portions of said box-like structure to form together an enclosure; said box-like structure and said inner basin joined at the top by interconnect wall means extending between like portions to complete said enclosure to thereby provide a double walled device varying in double wall thickness; a half moon cutout formed in the top of the front end double wall to receive the neck of the user; a plurality of openings in the bottom of said inner basin, and a plurality of openings in said two opposite side walls of said inner basin for the in flow of blow air into the inner basin; and opening means in an outer wall of said box-like structure for receiving the outlet of a hot air blow device for use of the structure as a hair drying hood; wherein a second cutout is provided at the bottom of the neck receiving cutout extended in the same direction as that of the user's neck providing pressure and space relief to the cervix of the neck; and barrier means in said second cutout to prevent fluid flow from said inner basin down a user's neck.

10. The portable hair drying hood of claim 9, wherein a plurality of canals at different angles are provided in the inner basin bottom; and with the canals having a plurality of openings throughout their lengths.

11. The portable hair drying hood of claim 9, wherein a removable "U" shaped conduit is mounted with opposite ends in opposite side openings of said inner basin and in fluid communication with the hot air in the double walled enclosure and pivotal with the ability to move in an arc over the user's head without interrupting the flow of hot air to that conduit when used in the drying hood.

12. The portable hair drying hood of claim 9, wherein grooves are provided in the outer side walls; and tilt support bracket means receivable in said grooves to hold the device at desired angles in operation.

13. The portable hair drying hood of claim 9, wherein opposite side grooves are provided in the two inner side walls of the inner basin to receive a baffle to shorten the drying compartment in the drying hood.

14. The portable hair drying hood of claim 9, wherein a recessed shoulder is formed around the top of the inner basin to receive a top basin cover.

* * * * *